US009212555B2

(12) United States Patent
Manier et al.

(10) Patent No.: US 9,212,555 B2
(45) Date of Patent: Dec. 15, 2015

(54) METHOD FOR REMOVING THE COATING FROM A GAS TURBINE COMPONENT

(75) Inventors: Karl-Heinz Manier, Scheyern (DE); Thomas Uihlein, Dachau (DE); Carl-Stefan Thöne, Rhede (DE)

(73) Assignees: MTU Aero Engines GmbH, Munich (DE); AB Solut Chemie GmbH, Rheinbreitbach (DE)

( * ) Notice: Subject to any disclaimer, the term of this patent is extended or adjusted under 35 U.S.C. 154(b) by 1064 days.

(21) Appl. No.: 12/088,800

(22) PCT Filed: Oct. 10, 2006

(86) PCT No.: PCT/DE2006/001766

§ 371 (c)(1), (2), (4) Date: Aug. 12, 2008

(87) PCT Pub. No.: WO2007/041998

PCT Pub. Date: Apr. 19, 2007

(65) Prior Publication Data

US 2009/0302004 A1 Dec. 10, 2009

(30) Foreign Application Priority Data

Oct. 14, 2005 (DE) ..... 10 2005 049 249

(51) Int. Cl.

| | |
|---|---|
| ***C03C 25/68*** | (2006.01) |
| ***C03C 15/00*** | (2006.01) |
| ***F01D 5/00*** | (2006.01) |
| ***C23F 1/44*** | (2006.01) |
| ***C23G 1/10*** | (2006.01) |
| ***F01D 5/28*** | (2006.01) |

(52) U.S. Cl.

CPC . *F01D 5/005* (2013.01); *C23F 1/44* (2013.01); *C23G 1/106* (2013.01); *F01D 5/288* (2013.01)

(58) Field of Classification Search

CPC ..... F01D 5/288; F01D 5/005; C23F 1/44; C23G 1/106

USPC ..... 216/95, 2, 83, 100, 103, 104, 109

See application file for complete search history.

(56) References Cited

U.S. PATENT DOCUMENTS

| | | | | |
|---|---|---|---|---|
| 3,438,901 | A * | 4/1969 | Vassileff | 252/79.3 |
| 3,833,414 | A | 9/1974 | Grisik et al. | |
| 4,746,369 | A * | 5/1988 | Sullivan et al. | 134/3 |
| 4,900,398 | A * | 2/1990 | Chen | 216/109 |
| 5,248,386 | A * | 9/1993 | Dastolfo et al. | 216/41 |
| 5,858,463 | A | 1/1999 | Ogura et al. | |
| 5,972,424 | A | 10/1999 | Draghi et al. | |
| 6,132,520 | A * | 10/2000 | Schilbe et al. | 134/2 |
| 6,355,116 | B1 * | 3/2002 | Chen et al. | 148/280 |
| 6,379,749 | B2 * | 4/2002 | Zimmerman et al. | 427/307 |
| 6,432,219 | B1 | 8/2002 | Wijngaard et al. | |
| 6,488,729 | B1 * | 12/2002 | Ishitobi et al. | 51/307 |
| 6,706,122 | B2 * | 3/2004 | Wijngaard et al. | 134/26 |
| 6,793,838 | B2 * | 9/2004 | Hansen et al. | 216/100 |
| 6,916,429 | B2 * | 7/2005 | Kool et al. | 216/104 |
| 6,936,543 | B2 * | 8/2005 | Schroeder et al. | 438/692 |
| 7,078,073 | B2 * | 7/2006 | Rigney et al. | 427/142 |
| 7,094,450 | B2 * | 8/2006 | Nagaraj et al. | 427/454 |
| 7,271,136 | B2 * | 9/2007 | Britton | 510/109 |
| 7,425,278 | B2 * | 9/2008 | Semkow et al. | 216/90 |
| 7,927,709 | B2 * | 4/2011 | Eichmann et al. | 428/469 |
| 8,377,324 | B2 * | 2/2013 | Fairbourn | 216/95 |
| 2001/0013356 | A1 * | 8/2001 | Wijngaard et al. | 134/26 |
| 2004/0045936 | A1 * | 3/2004 | Davis et al. | 216/100 |
| 2005/0152805 | A1 | 7/2005 | Arnold et al. | |
| 2005/0161439 | A1 * | 7/2005 | Wustman et al. | 216/103 |
| 2008/0169270 | A1 * | 7/2008 | Parkos et al. | 216/100 |
| 2009/0017636 | A1 * | 1/2009 | Kumazawa et al. | 438/745 |

FOREIGN PATENT DOCUMENTS

| | | | |
|---|---|---|---|
| DE | 2 339 608 | A | 3/1974 |
| DE | 41 01 843 | C1 | 4/1992 |
| DE | 4101843 | | 4/1992 |
| DE | 41 10 595 | C1 | 11/1992 |
| DE | 43 39 502 | C2 | 6/1995 |
| DE | 4339502 | | 6/1995 |
| DE | 199 24 589 | A1 | 11/2000 |
| DE | 19924589 | | 11/2000 |
| EP | 0 506 928 | B1 | 10/1992 |
| EP | 1 029 117 | B1 | 8/2000 |
| WO | 92/07110 | | 4/1992 |
| WO | WO 2005/066384 | A1 | 7/2005 |
| WO | WO 2005/073433 | A1 | 8/2005 |

OTHER PUBLICATIONS

"Data Profile of NTPA", IRPTC.*

"Data Profile of NTPA", IRPTC, available online Sep. 28, 2006 at http://www.inchem.org/documents/sids/sids/6419198.pdf (per WayBack Machine, http://web.archive.org). As previously cited on PTO-892 Paper No. 20111114.*

German Office Action from German Patent Application No. 10 2005 049 249.5, dated Sep. 15, 2015.

* cited by examiner

*Primary Examiner* — Nadine Norton
*Assistant Examiner* — Christopher Remavege
(74) *Attorney, Agent, or Firm* — Greer, Burns & Crain, Ltd.

(57) ABSTRACT

A method for removing the coating from a gas turbine component, namely for the complete or partial removal of a multilayer wear protection coating from the surface of the gas turbine component, the wear protection coating having at least one relatively hard ceramic layer and at least one relatively soft metallic layer, wherein, in order to remove the multilayer wear protection coating, the gas turbine component is alternately positioned in two different chemical baths, a first bath being used exclusively for the removal of each relatively hard ceramic layer, and a second bath being used exclusively for the removal of each relatively soft metallic layer of the wear protection coating.

15 Claims, No Drawings

METHOD FOR REMOVING THE COATING FROM A GAS TURBINE COMPONENT

BACKGROUND

The present invention relates to a method for removing the coating from a gas turbine component 1.

Components of a gas turbine, such as the blades, are provided with special wear protection coatings in order to provide resistance to oxidation, resistance to corrosion, or resistance to erosion on their surfaces. During operation of gas turbines, the components of these turbines are subjected to wear, or can be damaged in other ways. In order to repair damages, as a rule it is necessary to partly or completely remove or abrade the wear protection coating from the component to be repaired in some areas. The removal or abrading of coatings is also called de-coating or coating removal. A distinction is made between coating removal methods in which the coating removal takes place mechanically, chemically, or electrochemically.

Standardly, wear protection coatings are realized as what are known as multilayer coatings made up of a plurality of layers applied in alternating fashion to the gas turbine component. Thus, for example it is possible for a wear protection coating realized as a multilayer coating to comprise a relatively soft metallic layer and a relatively hard ceramic layer that are applied to the gas turbine component multiple times in alternating fashion one after the other. In addition, wear protection coatings are known from practical use in which more than two different layers are applied to the gas turbine component in alternating fashion one after the other, such as multilayer coatings made up of four layers that are applied to the gas turbine component in alternating fashion one after the other, namely a first, metallic and therefore relatively soft layer that is adapted to the material composition of the gas turbine component, another metallic layer that is also relatively soft and that is made of a metal alloy, a third, relatively hard graded metal-ceramic layer, and a fourth relatively hard ceramic layer.

Up to now, from the prior art no method has been known with which wear protection coatings fashioned as multilayer coatings can be effectively removed without running the risk of damaging the gas turbine component.

SUMMARY

On the basis of this, the present invention is based on the problem of creating a new method for removing the coating from a gas turbine component.

This problem is solved by a method for removing the coating from a gas turbine component. According to the present invention, in order to remove the multilayer wear protection coating, the gas turbine component is alternately positioned in two different chemical baths, a first bath being used exclusively for the removal of the, or each, relatively hard ceramic layer, and a second bath being used exclusively for the removal of the, or each, relatively soft metallic layer of the wear protection coating.

In the sense of the present invention, it is proposed to situate the component having a multilayer wear protection coating alternately in different baths, such that the different baths selectively remove either a relatively hard ceramic layer or a relatively soft metallic layer of the wear protection coating that is to be removed. In this way, for the first time a method is proposed with the aid of which gas turbine components can be effectively freed of a multilayer wear protection coating without running the risk of damaging the gas turbine component.

According to an advantageous development of the present invention, the first bath, which is used exclusively for removing the, or each, relatively hard ceramic layer, is an acid made up of a hydrogen peroxide solution and at least one sodium salt and/or potassium salt of an organic acid contained therein. Alternatively or in addition to the sodium salt and/or potassium salt, the first bath can include an organic compound containing nitrogen. The hydrogen peroxide solution can, if warranted, also be replaced by a mixture of hydrofluoric acid and nitric acid. The first bath has a pH value of between 3 and 5.

The second bath, which is used exclusively to remove the, or each, relatively soft metallic layer, is a base made up of an aqueous solution of at least one alkali hydroxide or earth alkali hydroxide containing silicon or silicon compounds and/or phosphorus or phosphorus compounds, the second bath having a pH value of at least 12.

Preferably, the first bath is a 5 w/v % to 50 w/v % hydrogen peroxide solution having 10 g/l to 100 g/l sodium salts of organic acid. Alternatively or in addition to the sodium salts, the first bath can contain 1 g/l to 10 g/l of an organic compound containing nitrogen. The second bath is preferably a 2 w/v % to 50 w/v % alkali hydroxide solution having 1 g/l to 200 g/l silicon or silicon compounds and/or 10 g/l to 100 g/l phosphorus or phosphorus compounds.

According to another advantageous development of the present invention, in order to remove a relatively hard ceramic layer the gas turbine component is positioned in the first bath at a temperature between 10° C. and 70° C. for a duration of 1-60 minutes per 1 nm thickness of the layer that is to be removed. In order to remove a relatively soft metallic layer, the gas turbine component is positioned in the second bath at a temperature between 20° C. and 150° C. for a duration of 10-120 minutes per 1 nm thickness of the layer to be removed.

DETAILED DESCRIPTION

Preferred developments of the present invention result from the following description. An exemplary embodiment of the present invention is described in greater detail in the following.

The method according to the present invention is used for removing coatings of gas turbine components coated with multilayer wear protection coatings, the multilayer wear protection coatings being formed from at least two different layers that are situated one after the other in alternating fashion, namely ceramic relatively hard layers and metallic relatively soft layers situated one after the other in alternating fashion. Preferably, the method is used to remove the coatings from gas turbine components on which a wear protection coating has been applied that is made up of four different layers that succeed one another in alternating fashion.

In a gas turbine component formed from a titanium base material, the first layer is preferably formed from titanium or palladium or platinum. To the first layer, a second layer is applied that is preferably formed from a TiCrAl material. As a third layer, a grading layer follows that is formed from a TiAlN1-x material. The third layer is followed by a fourth layer made of titanium aluminum nitride (TiAlN). These four layers are applied one after the other in alternating fashion onto the gas turbine component in order to form a multilayer wear protection coating, the first and second layer each being metallic and relatively soft and the third and fourth layer each being ceramic and relatively hard.

In order to remove such multilayer wear protection coatings from a gas turbine component, according to the present invention it is proposed that the gas turbine component be alternately positioned in two different chemical baths, a first bath being used exclusively to remove the, or each, relatively hard ceramic layer, and a second bath being used exclusively to remove the, or each, relatively soft metallic layer of the wear protection coating.

The first bath, which is used exclusively to remove the, or each, relatively hard ceramic layer, is an acid of a hydrogen peroxide solution and at least one sodium salt and/or potassium salt of an organic acid contained therein. Alternatively or in addition to the sodium salt and/or potassium salt, the first bath can contain an organic compound that contains nitrogen. The hydrogen peroxide solution can, if warranted, also be replaced by a mixture of hydrofluoric acid and nitric acid.

Preferably, the first bath is formed from a 5% to 50% hydrogen peroxide solution containing 10 g/l to 100 g/l sodium salts of organic acids. The pH value of this first bath is between 3 and 5.

The second bath, which is used exclusively to remove the, or each, relatively soft metallic layer, is a base of an aqueous solution of at least one alkali hydroxide or earth alkali hydroxide containing silicon and/or phosphorus and/or containing silicon compounds and/or phosphorus compounds.

Preferably, the second bath is a base of a 2 w/v % to 50 w/v % alkali hydroxide solution containing 1 g/l to 200 g/l silicon compounds and 10 g/l to 100 g/l phosphorus compounds. The pH value of this second bath is at least 12.

In a specific embodiment, the first bath is an acid made up of a 10 w/v % hydrogen peroxide solution having 70 g/l ethylene diamine tetraacetate sodium salt and 20 g/l phenol-4-sulfonic acid-sodium salt, and the second bath is a 20 w/v % alkali hydroxide solution having 100 g/l silicon compounds and 50 g/l phosphorus compounds.

As already mentioned, in order to remove the wear protection coating the gas turbine component is alternately positioned in the first bath and the second bath, the first bath being used selectively only to remove the hard ceramic layer and the second bath being used exclusively to remove the soft metallic layer. In order to remove a ceramic layer, a gas turbine component is accordingly positioned in the first bath, the first bath having for this purpose a temperature between 10° C. and 70° C. Preferably, the temperature of this bath is of the order of magnitude of room temperature, i.e. approximately 20° C. The gas turbine component is situated in this bath for a duration of 1 to 60 minutes per 1 nm thickness of the ceramic relatively hard layer that is to be removed. In order to remove a metallic relatively soft layer of the wear protection coating, the gas turbine component is positioned in the second bath, the temperature of this second bath being between 20° C. and 150° C., preferably 80° C. The component is positioned in the second bath for a duration between 10 minutes and 120 minutes per 1 nm thickness of the metallic relatively soft layer that is to be removed. The gas turbine component whose coating is being removed may be rinsed when being repositioned between the two baths.

The method according to the present invention permits the effective removal of what are known as multilayer wear protection coatings from gas turbine components without running the risk of damaging the gas turbine component. With the aid of the method according to the present invention, wear protection coatings can be removed from a gas turbine component completely or only partially; for the partial removal of the wear protection coatings, a gas turbine component is either immersed only partly in the baths, or areas of the gas turbine component from which the coating is not to be removed are provided with a protective layer, e.g. made of wax, before being immersed in the corresponding bath.

The invention claimed is:

1. A method for removing a wear protection coating from a surface of a gas turbine component, the wear protection coating having at least one relatively hard ceramic layer and at least one relatively soft metallic layer, the method comprising:

alternately positioning the gas turbine component in two different chemical baths for at least partially removing the wear protection coating from the gas turbine component without damaging the surface of the gas turbine component by removing a portion of the surface, a first bath being used exclusively for the removal of each relatively hard ceramic layer of the wear protection coating, and a second bath being used exclusively for the removal of each relatively soft metallic layer of the wear protection coating, the component being sequentially positioned in the respective first and second baths corresponding to the disposition of the at least one relatively hard ceramic layer and the at least one soft metallic layers on the component, wherein said first bath is an acid consisting of a hydrogen peroxide solution and at least one sodium salt and/or potassium salt of an organic acid contained therein, and wherein said first bath has a pH value between 3 and 5; and wherein said second bath is formed from a 5 w/v % to 50 w/v % alkali hydroxide solution.

2. The method as recited in claim 1, wherein said first bath is the hydrogen peroxide solution having 10 g/l to 100 g/l sodium salts of organic acids.

3. The method as recited in claim 1, wherein said first bath, which is used exclusively for the removal of each relatively hard ceramic layer, is an acid made up of a hydrogen peroxide solution and an organic compound containing nitrogen contained therein.

4. The method as recited in claim 3, wherein said first bath is the hydrogen peroxide solution having 1 g/l to 10 g/l of the nitrogen-containing compound.

5. The method as recited in claim 1, wherein said first bath, which is used exclusively for the removal of each relatively hard ceramic layer, is an acid made up of a hydrogen peroxide solution, at least one sodium salt and/or potassium salt of an organic acid contained therein, and a nitrogen-containing organic compound contained therein.

6. The method as recited in claim 5, wherein said first bath is the hydrogen peroxide solution having 10 g/l to 100 g/l sodium salts of organic acids and 1 g/l to 10 g/l of the nitrogen-containing organic compound.

7. The method as recited in claim 1, wherein said first bath is a mixture of hydrofluoric acid and nitric acid, and in addition contains at least one sodium salt and/or potassium salt of an organic acid and/or a nitrogen-containing organic compound.

8. The method as recited in claim 1, wherein said removal of a relatively hard ceramic layer, the gas turbine component is positioned in the first bath at a temperature between 10° C. and 70° C. for a duration of 1-60 minutes per 1 nm thickness of the layer that is to be removed.

9. The method as recited in claim 1, wherein said second bath, which is used exclusively for the removal of each relatively soft metallic layer, is a base made up of an aqueous solution of at least one alkali hydroxide or earth alkali hydroxide containing silicon or silicon compounds and/or phosphorus or phosphorus compounds.

10. The method as recited in claim 9, wherein said second bath is the alkali hydroxide solution having 1 g/l to 200 g/l silicon or silicon compounds and/or 10 g/l to 100 g/l phosphorus or phosphorus compounds.

11. The method as recited in claim 9, wherein said second bath, which is used exclusively for the removal of each relatively soft metallic layer, has a pH value greater than 12.

12. The method as recited in claim 1, wherein in said removal of a relatively soft metallic layer, the gas turbine component is positioned in the second bath at a temperature between 20° C. and 150° C. for a duration of 10-120 minutes per 1 nm thickness of the layer that is to be removed.

13. A method for removing a wear protection coating from a surface of a gas turbine component, the wear protection coating having at least one relatively hard ceramic layer and at least one relatively soft metallic layer, the method comprising:

alternately positioning the gas turbine component in two different chemical baths for at least partially removing the wear protection coating from the gas turbine component without damaging the surface of the gas turbine component by removing a portion of the surface, a first bath being used exclusively for the removal of each relatively hard ceramic layer of the wear protection coating, and a second bath being used exclusively for the removal of each relatively soft metallic layer of the wear protection coating, the component being sequentially positioned in the respective first and second baths corresponding to the disposition of the at least one relatively hard ceramic layer and the at least one soft metallic layers on the component, said first bath is an acid solution taken from the group consisting of a hydrogen peroxide solution, a hydrogen peroxide solution and organic compound containing nitrogen contained therein, and a hydrofluoric acid and a nitric acid, and at least one sodium salt and/or potassium salt of an organic acid contained therein, wherein said first bath has a pH value between 3 and 5, and said second bath is a base formed from a 5 w/v % to 50 w/v % alkali hydroxide solution containing silicon or silicon compounds and/or phosphorus or phosphorus compounds.

14. The method as recited in claim 1, wherein said second bath has a pH of at least 12.

15. The method as recited in claim 13, wherein said second bath has a pH of at least 12.

* * * * *